United States Patent [19]

Johnson et al.

[11] Patent Number: 4,832,369

[45] Date of Patent: May 23, 1989

[54] WIND RESISTANT CLIPBOARD/PADHOLDER

[76] Inventors: Gary W. Johnson; Brad W. Johnson, both of 4730 Table Mesa Dr., Boulder, Colo. 80303

[21] Appl. No.: 114,492

[22] Filed: Oct. 30, 1987

[51] Int. Cl.[4] ..... B42D 5/00; B42D 1/00; B42D 3/00; G09F 1/10

[52] U.S. Cl. ..... 281/18; 281/31; 281/15.1; 40/159

[58] Field of Search ..... 281/15 B, 15 R, 18, 281/31; 283/6; 273/236; 40/152, 152.1, 159, 160, 155, 157

[56] References Cited

U.S. PATENT DOCUMENTS

| | | | |
|---|---|---|---|
| 2,473,938 | 6/1949 | Cannizzaro et al. | 281/15 R |
| 2,953,397 | 9/1960 | Diamond | 281/15 R |
| 3,048,424 | 8/1962 | Mitchell, Jr. | 281/31 |
| 3,503,141 | 3/1970 | Schwartz | 281/31 |
| 4,306,737 | 12/1981 | Errichiello | 281/31 |
| 4,470,620 | 9/1984 | Gerch | 281/31 |
| 4,488,645 | 12/1984 | Yamaguchi | 281/18 |
| 4,636,179 | 1/1987 | Gentile et al. | 281/31 |
| 4,637,631 | 1/1987 | Baer | 281/15 R |
| 4,676,527 | 6/1987 | Palmer | 40/159 |
| 4,724,957 | 2/1988 | Burgschweiger | 281/31 |

*Primary Examiner*—Frank T. Yost
*Assistant Examiner*—Paul M. Heyrana
*Attorney, Agent, or Firm*—Bruce J. Clark

[57] ABSTRACT

A clipboard/padholder for holding, reading or writing on paper or a tablet while in a wind and to store and/or protect the paper from damage during heavy use or abuse of the clipboard. A frame having an opening holds the tablet or paper securely in place on all four sides. The frame is hinged to allow quick and easy access to changing the paper or turning pages. A cover that is hinged to the backboard and frame allows the paper to be protected from rain or snow when not in use or when laid down temporarily and allows for preserving confidentiality.

16 Claims, 3 Drawing Sheets

WIND RESISTANT CLIPBOARD/PADHOLDER

BACKGROUND OF THE INVENTION

This invention relates to clipboards and padholders and their use both outdoors and indoors, although it relates more particularly to their use in the outdoors.

Known clipboards and padholders, although available in a variety of styles, forms and designs, have the general purpose of securing one or more sheets of paper, forms or a tablet, to a hardback in order to allow the user to more easily read and write, or draw on the paper. Paper is secured to the clipboard on one side or edge of the paper and for this reason the paper is loose on all remaining sides when in use. When used outdoors, these clipboards allow wind to blow the papers and/or their corners. Relocating the proper page, reading turned up or worn corners of pages, rewriting or re-preparing worn pages, result in significant annoyance, loss of time, loss of productivity and mental frustration to the user. Such is the case for example, in the construction industry, particularly for roofing contractors, in the insurance industry for adjusters, and in athletics or other outdoor activities, particularly with coaches. Makeshift fasteners have resulted, such as rubber bands being placed around the clipboard and paper. These, however, result in torn paper where the rubber band meets the paper and, just as important, do not allow for quick and easy turning of the pages of the subject tablet.

It is, therefore, an object of this invention to provide a clipboard/padholder that eliminates these problems entirely in a convenient, efficient and attractive manner by allowing for the reading of, or writing on, paper on a lightweight portable clipboard padholder while maintaining neatness on all four edges of the paper, in a small or high wind without the paper or any portion of it blowing or moving, yet still allow for easy and quick access to the paper for removing it or turning the pages. It is a further object of the invention to provide a sturdily designed clipboard that, when in use and dropped or abused, will protect the interior papers.

Other objects and features of the invention and objectives and the manner in which the invention achieves its purpose will be appreciated from the following description and the accompanying drawings which exemplify the invention, it being understood that changes may be made in the specific apparatus disclosed herein without departing from the essentials of the invention set forth in the appended claims.

BRIEF SUMMARY OF THE INVENTION

The present invention relates to a wind resistant clipboard/padholder for holding paper comprised of a hinged frame which closes over the paper on the clipboard/padholder on all four sides of the subject paper being read or written on, which frame is then secured closed by snap together or other latching means. This allows the clipboard user to read or write on the paper in wind and protects the paper from abuse during use. In another form of the invention, a flat cover also is hinged to the frame hinge to fold over and cover both the hinged frame and subject page to protect the page from rain or other elements and to preserve the confidentiality of the contents.

Figure 1:
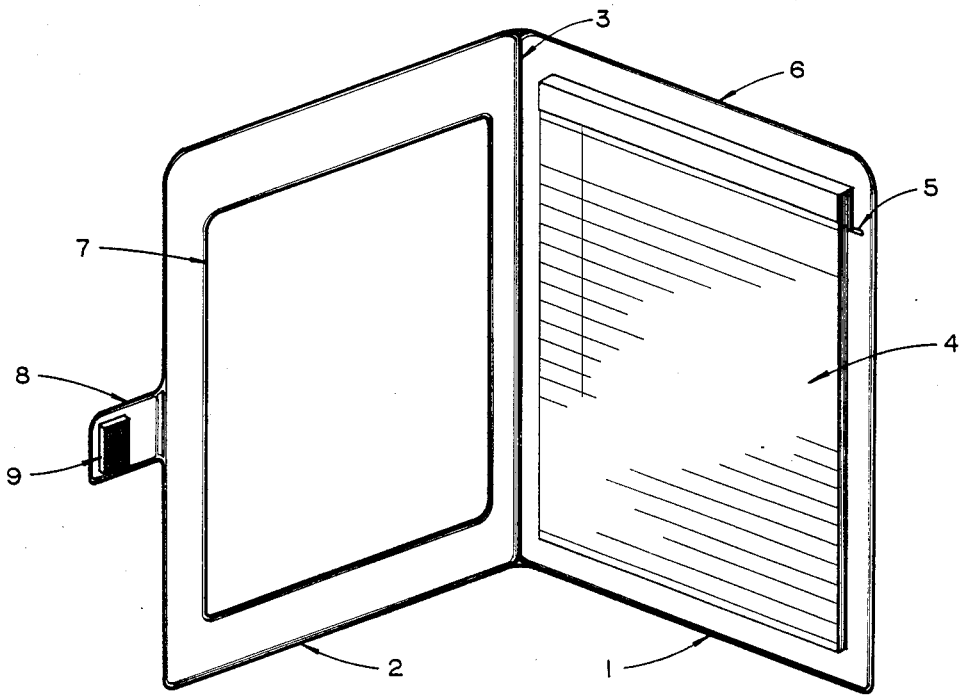
FIG. 1 is a front, perspective view of the invention, showing it in an opened position.

DESCRIPTION OF THE PREFERRED EMBODIMENTS:

Referring to FIG. 1, the invention shown has two flat rigid members 1 and 2, preferably a hardboard, enveloped by vinyl or leather. These are hinged together by hinging means 3 which is shown as the vinyl or leather itself. The backboard rigid member 1 has secured to it the subject paper or tablet 4 by conventional means such as a clip 10 at the top or as shown in FIG. 1 the means is a slit 5 in the vinyl 6 for the cardboard backing of the tablet to slide into.

The rigid member 2 has an opening 7 of a size approaching the outer dimensions of the rigid member itself yet just slightly smaller than the anticipated paper or tablet size creating a frame that hinges and folds over the paper 4. When folded or hinged closed in this manner, the frame secures all four edges of the paper 4 allowing the paper to be read or written on yet resisting any other movement of the paper caused by wind, or other external force.

The hinge 3 can be any hinging device, metal or plastic, but the preferred embodiment is of vinyl, leather or flexible plastic heat welded to create a firm yet flexible joint. The vinyl can be of the same type or from the same material that envelops the frame and backboard in FIG. 6.

Figure 2:
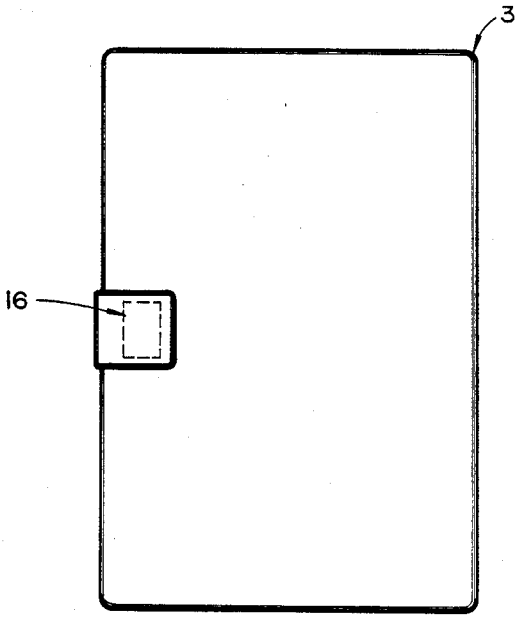
FIG. 2 is the rear view of the invention shown in FIG. 1.
Figure 3:
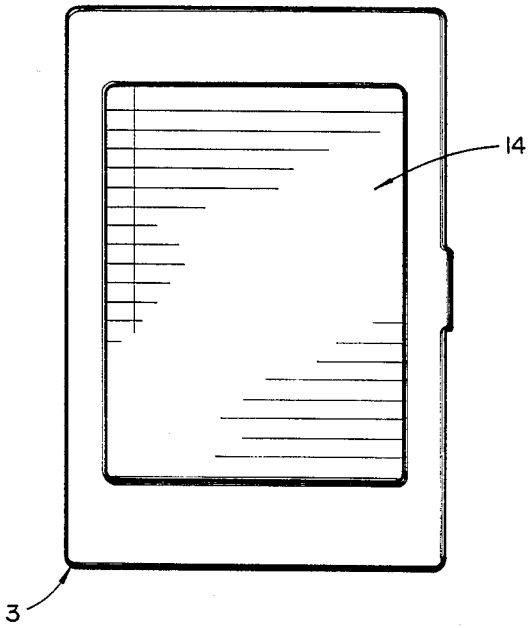
FIG. 3 is a front plane view, showing the invention of FIG. 1, in a closed position.
Figure 4:
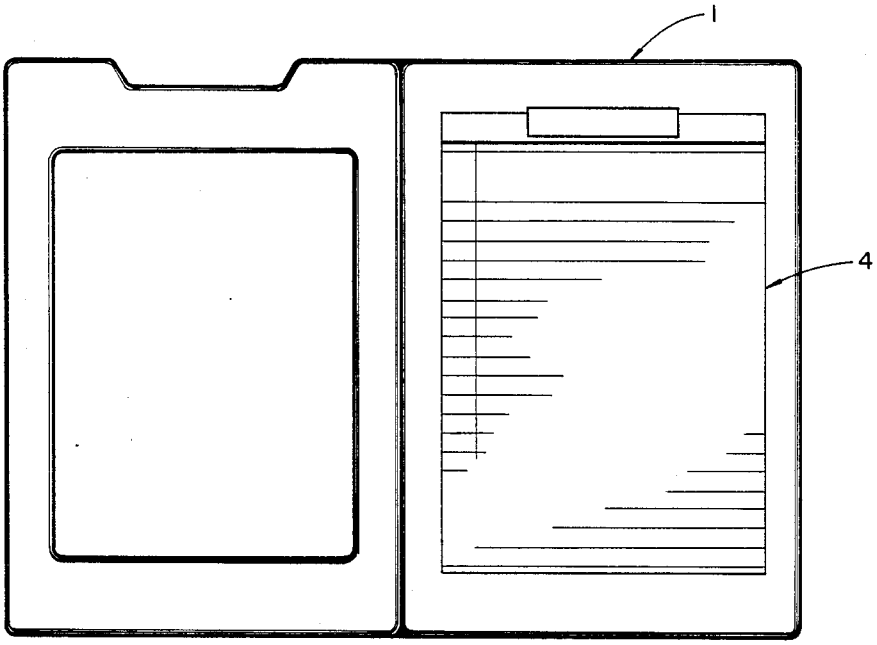
FIG. 4 is a front view of alternative form of the invention, shown in an open view.

The paper 4 is made more secure from damage from accidental droppage of the clipboard/padholder while in use by the latching means 8 in FIG. 1 which physically connects the frame 2 and backboard 1. This latching means is shown as a strap 8 with VELCRO, 9, affixed, which strap folds around the side of the backboard to be attached to a corresponding VELCRO patch 16 on the back side of the clipboard, as shown in FIG. 2. It should be understood that this latching means can be placed at any one of the three remaining non-hinged sides of the clipboard and can be any latching means, including snaps or metal latches or locks presently available. The secured paper or tablet 4 is shown in FIG. 3. in the closed position over the backboard 1 and paper 4.

Figure 5:
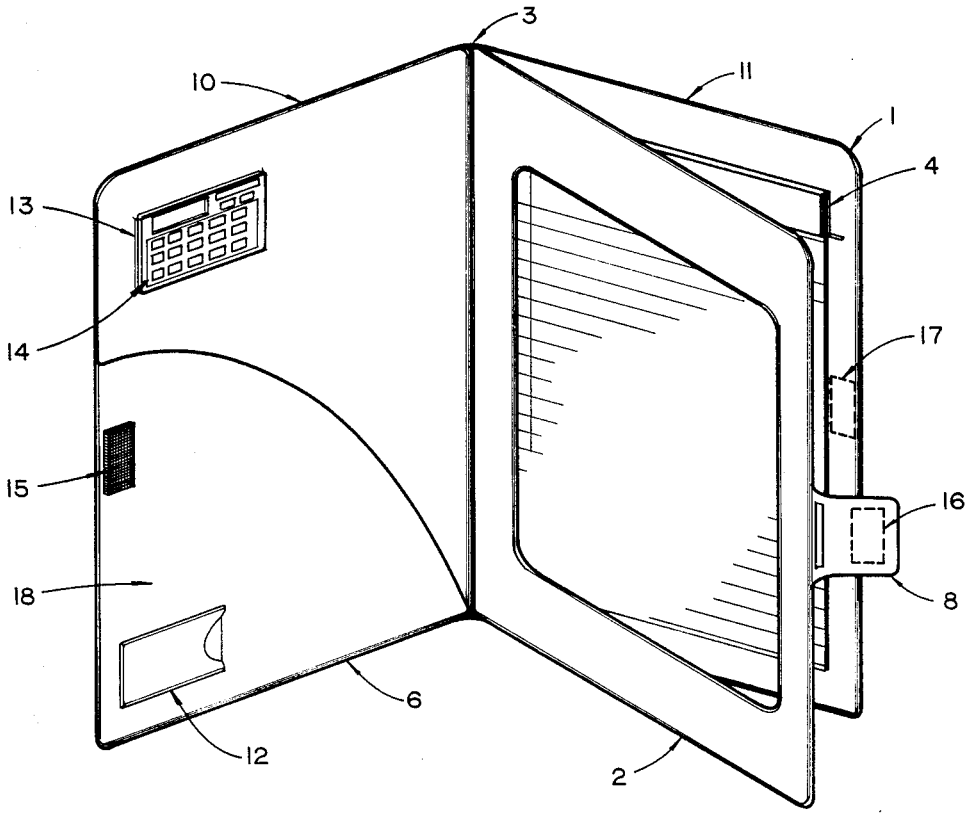
FIG. 5 is a front perspective view of another form of the invention shown in an open position.

Another form of the invention having additional features is shown in FIG. 5. An additional flat cover 10 is added and hinged at the hinge 3. This cover 10 can be closed over the frame 2 to protect the paper from rain or other elements and to preserve confidentiality of the contents of the paper. It can itself have a latching means to secure it closed although such is not shown in the figures. The cover 10 does have a VELCO piece 15 on its inside so that when the cover is hinged, and opened back against the back side of the backboard 1 the latching strap 8 can secure the frame 2 as well as the cover 10 together securely to the VELCRO 15 while the subject paper 4 is being used. Moreover, unneeded pages of the tablet 4 can be turned up over the top 11 and secured between the backside of the backboard 1 and the cover 10.

The frame 2 in FIG. 5 can also be secured to the backboard via the VELCRO 16 and to the VELCRO 17 leaving the cover open for the use of the calculator.

In either mode as shown in FIG. 1 or FIG. 5 the clipboard may be modified to add means for holding business cards, calendars or pens. In FIG. 5 a clear plastic 12 is heat welded to the vinyl 6 on three sides so that business cards can be inserted in the fourth side and stored. Slits 13 are cut in the vinyl to secure a calculator 14. Other means may be used to secure the calculator. A pouch 18 is also attached as an added feature to store unused or unneeded papers or forms. The pouch is formed by heat welding vinyl 6 to the inside of the cover 10. It should be noted that leather or material other than vinyl can be used in any mode of the invention.

Figure 6:
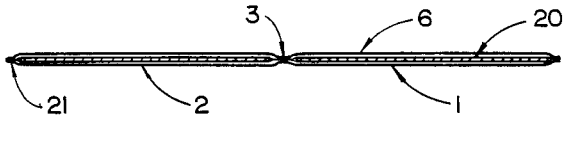
FIG. 6 is an end view of one form of the invention showing the one form of composition.

FIG. 6 shows the backboard and frame consisting of cardboard or chipboard 20 with a cover of vinyl 6 heat welded at the edges 21 and at the center hinge 3. This method of making is not exclusive as other ways of making these parts are envisioned and available.

Figure 7:
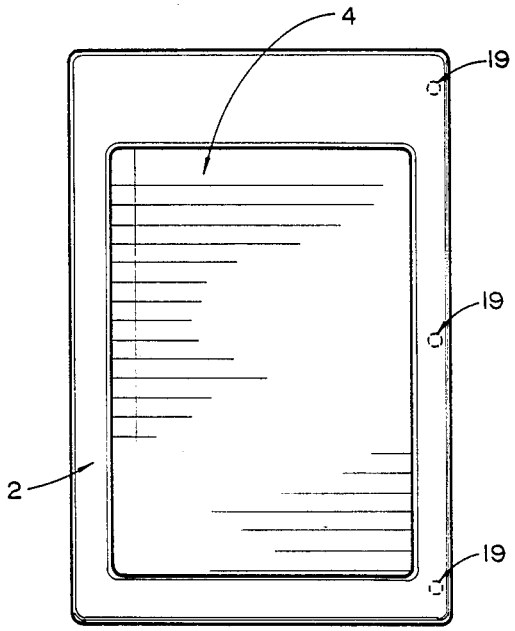
FIG. 7 is a front view of another form of the invention showing snap together means.

FIG. 7 shows snaps 19 as one alternate means of latching the frame 2 to the backboard securing the tablet 2.

Figure 8:
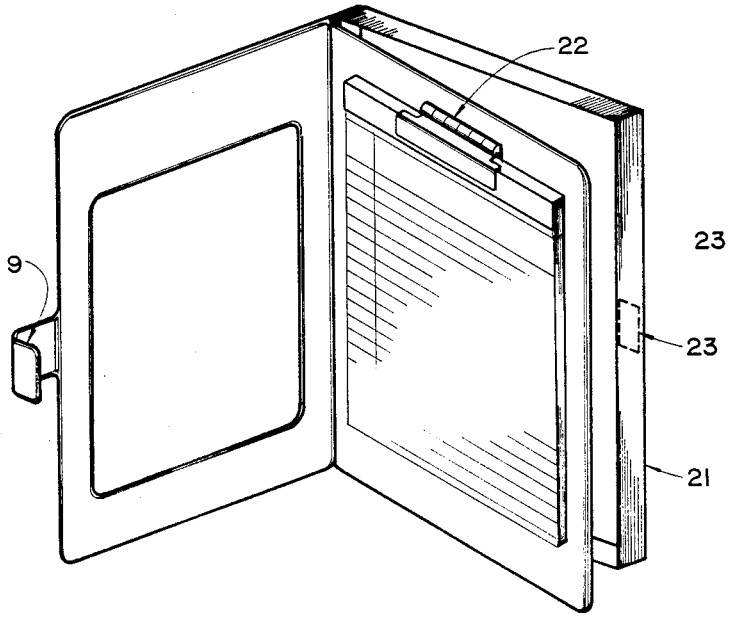
FIG. 8 is a front perspective view of another form of the invention.
Figure 9:
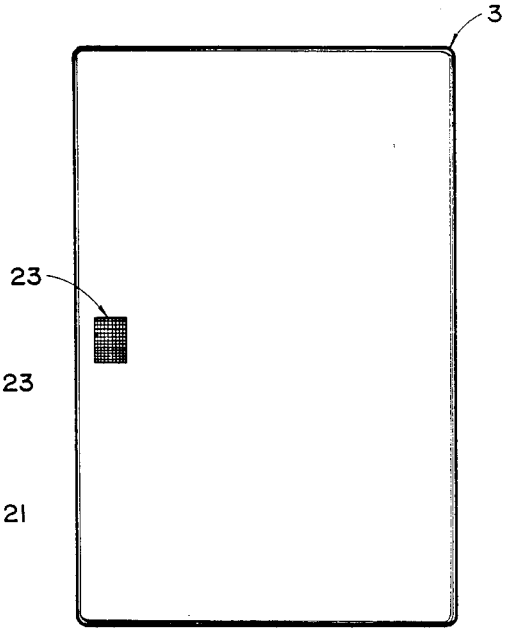
FIG. 9 is the rear view of the invention shown in FIG. 8.

Another variation of the invention is shown in FIG. 8. The clipboard is attached to a box 21 of rigid vinyl or plastic or other similar material preferably lightweight and made of the same material as the backboard or frame. The backboard 1 acts both as a writing backboard with the clip 22 to hold the paper and as a cover for the box. When the frame 2 is closed and latched shut with the strap 9 and the VELCRO 23 the box is secured tight. Policemen, adjusters, mail and package delivery servicemen and women, would find such a clipboard-/padholder useful to both store their forms in the box 21 and to keep the forms neat on all edges during their use.

The invention not only allows for use of the paper or tablet during a wind, but it also protects the paper from damage during heavy or rough use or if the clipboard is dropped or tossed and does so in an attractive and efficient manner. Moreover, this is achieved while maintained ease of use of the clipboard in terms of easily changing paper, turning pages, etc. One only needs to open the frame and the pressure is released from the paper, or tablet, allowing it to be turned or changed as the case may be. Furthermore, the new page is easily and quickly held secure with very little fuss, simply by closing the frame. The cover adds the feature of protection against the elements and protects the document's confidentiality, yet still allows the use of the open frame. It should likewise be noted that the size and shape of the invention may vary with the size of the paper needed; likewise, the size and shape of the opening 7 in the frame 2 may vary depending on the size and shape of the paper or tablet expected to be used.

While there have been shown and described particular embodiments of the invention, it will be obvious to those skilled in the art that changes and modifications may be made without departing from the invention or its equivalent, and, therefore, it is intended by the appended claims to cover all such changes and modifications as fall within the true spirit and scope of the invention.

We claim:

1. A clipboard/padholder for firmly yet releasably holding paper, including a plurality thereof in stacked form or in the form of a tablet with cardboard backing, while utilizing the topmost paper thereof by reading or writing on it in windy conditions or where it is desired to secure or maintain neatness of the edges of the paper, comprised of:

a. A flat rigid member comprising a backboard having at least one straight edge;

b. A second flat rigid member of shape substantially similar to the backboard and having an opening in the center, comprising a frame, hingedly connected to the backboard along one of the matching parallel opposed straight edges of the frame and backboard, said frame having an open and a closed position, whereby, in the closed position the paper or tablet is in a substantially coplanar relationship with the frame and backboard and is secured between them at and near the edges of the paper or tablet while exposing through the frame opening substantially all of the topmost paper for utilization; in the open position, the frame hinges away from the paper and backboard to a non-coplanar relationship therewith wherein all physical contact between the frame and paper ceases, for quick removal or replacement of the paper or tablet; the size of the frame opening is such that its dimensions are smaller than the dimensions of the frame perimeter, while allowing for substantially all of the topmost paper to be exposed through the frame opening except for the secured edges of the paper, for utilization of said topmost paper when the frame is in the closed position.

2. A clipboard/padholder for firmly yet releasably holding paper, including a plurality thereof in stacked form or in the form of a tablet with cardboard backing, while utilizing the topmost paper thereof by reading or writing on it in windy conditions and where it is desired to secure or maintain neatness of the edges of the paper, comprised of:

a. A flat rigid member comprising a backboard having at least one straight edge;

b. A second flat rigid member of shape substantially similar to the backboard and having an opening in the center, comprising a frame, hingedly connected to the backboard along one of the matching parallel opposed straight edges of the frame and backboard, said frame having an open and a closed position, whereby, in the closed position the paper or tablet is in a substantially coplanar relationship with the frame and backboard and is secured between them at and near the edges of the paper or tablet while exposing through the frame opening substantially all of the topmost paper for utilization; in the open position, the frame hinges away from the paper and backboard to a non-coplanar relationship therewith wherein all physical contact between the frame and paper ceases, for quick removal or replacement of the paper or tablet; the size of the frame opening is such that its dimensions are smaller than the dimensions of the frame perimeter, while allowing for substantially all of the topmost paper to be exposed through the frame opening except for the secured edges of the paper, for utilization of said topmost paper when the frame is in the closed position;

c. Means positioned on the backboard for releasably securing the paper or tablet to the backboard when the frame is in the open position;

d. Means for releasably latching the frame to the backboard in the closed position such that the edges of the paper or tablet are firmly secured between the frame and backboard.

3. A clipboard/padholder for firmly yet releasably holding paper, including a plurality thereof in stacked form or in the form of a tablet with cardboard backing, while utilizing the topmost paper thereof by reading or writing on it in windy conditions or where it is desired to secure or maintain neatness of the edges of the paper, comprised of:

a. A flat rigid member comprising a backboard having at least one straight edge;

b. A second flat rigid member of shape substantially similar to the backboard and having an opening in the center, comprising a frame, hingedly connected to the backboard along one of the matching parallel opposed straight edges of the frame and backboard, said frame having an open and a closed position, whereby, in the closed position the paper or tablet is in a substantially coplanar relationship with the frame and backboard and is secured between them at and near the edges of the paper or tablet while exposing through the frame opening substantially all of the topmost paper for utilization; in the open position, the frame hinges away from the paper and backboard to a non-coplanar relationship therewith wherein all physical contact between the frame and paper ceases, for quick removal or replacement of the paper or tablet; the size of the frame opening is such that its dimensions are smaller than the dimensions of the frame perimeter, while allowing for substantially all of the topmost paper to be exposed through the frame opening except for the secured edges of the paper, for utilization of said topmost paper when the frame is in the closed position;

c. Means positioned on the backboard for releasably securing the paper or tablet to the backboard when the frame is in the open position allowing the frame to properly close to its closed position;

d. Means for releasably latching the frame to the backboard in the closed position such that the edges of the paper or tablet are firmly secured between the frame and backboard;

e. A third flat rigid member of a size at least as large as that of the frame opening, said member comprising a cover, and having an inside and outside surface defined by its opposite planar surfaces respectively, said cover hingedly connected along the edges of the backboard and frame having the hinge between the backboard and frame, to the corresponding parallel opposed edge of the cover, and hinging to a closed position such that the inner surface of the cover is in a facing coplanar relationship with the frame and entirely covers the frame opening.

4. The clipboard/padholder in claim 2 wherein the rigid backboard is substantially rectangular in shape, and further having a shallow substantially rectangular housing with a flat rigid bottom and four flat rigid corresponding sidewalls, wherein the bottom is of a size and shape substantially similar to that of the backboard, each sidewall having the same width and that is substantially less than its length, the sidewalls connected together at the shorter ends to form the sidewalls of the receptacle and each sidewall having one of its lengthwise edges connected to the matched opposed parallel edge of the bottom and the remaining parallel lengthwise unopposed lengthwise edge of each sidewall not connected to either the bottom or remaining sidewalls; means for hingedly connecting the unopposed edge of one sidewall to the matching opposed parallel edge of the backboard such that the backboard comprises a hinged cover for the rectangular housing and contacts all unopposed edges of the sidewall when closed; means for releasably securing the rectangular housing to the backboard in the closed position, thus providing a specialized clipboard/padholder having a built-in storage compartment operating in conjunction therewith, for holding and storing paper and other items.

5. The clipboard/padholder in claim 4 wherein the means for releasably latching the frame to the backboard and the means for releasably securing the backboard to the receptacle are comprised of a tab of relatively thin bendable material affixed to and protruding outwardly from one non-hinged edge of the frame in the same plane as the frame having affixed on its planar surface facing the plane having it in the paper or tablet one-half of a mating pair of velcro pads, and the other pad of said velcro pair affixed to the outside surface of the matching opposing sidewall of the receptacle nearest the tab when the frame and box are in the closed position such that the tab can be folded around the edge of the backboard to selectably join its velcro pad with the mated velcro pad on the receptacle to releasably secure the frame backboard, and box simultaneously.

6. The clipboard/padholder as in claim 2 wherein the backboard and frame are tightly enveloped on all surfaces and connected together along a matched opposed parallel edge in a slightly spaced apart parallel matching relationship by a sheath of relatively thin flexible material, whereby the hinging means is comprised of the flexible material itself so connecting said backboard and frame together wherein the backboard and frame are connected together at the hinged edge in slightly spaced apart parallel relationship.

7. The clipboard/padholder in claim 6 wherein the sheath is comprised of vinyl-like material and means for attaching edges of the sheath to each other is heat sealing; hinging means is enhanced by heat sealing the vinyl material between the backboard and frame at the hinged connection; means for securing a tablet to the backboard are comprised of a slit cut in the sheath of material enveloping the tablet receiving planar surface of the backboard, said slit positioned to allow the tablet cardboard backing to insert slidably therethrough between the sheathing and backboard surface to a secure position such that the frame hinges to a closed position securing only the edges of the paper on the tablet.

8. The clipboard/padholder in claims 2 or 3, wherein the means for releasably securing the tablet or paper is a clip to which one side of the paper or tablet releasably engages, said clip being permanently affixed to the backboard in a position near one edge of the backboard such that when the frame is in a closed position, substantially all of the topmost paper, except for the edges secured between the frame and the backboard, are exposed through the frame opening.

9. The clipboard/padholder in claims 2 or 3, 6, wherein the means for releasably latching the frame to the backboard is comprised of a tab of relatively thin flexible material affixed to and protruding outwardly from one non-hinged side of the frame in the same plane as the frame, one half of a mating pair of velcro pads affixed to the planar surface of the tab facing the plane having in it the paper or tablet, and the other pad of the said velcro pair affixed to the backboard plane surface opposite that backboard surface having the paper or tablet thereon, said pad positioned near the edge of the backboard surface and opposite the tab at a distance from said edge sufficient to enable the frame to firmly secure the edges of the paper when the pad on the flexible tab is selectively mated with the said second pad, thus providing a flexible tab that can be folded around the edge of the backboard to selectively join the mated velcro pads to not only close the frame to the backboard but also firmly secure the edges of the paper or tablet therebetween.

10.The clipboard/padholder in claims 2 or 3, where the means for releasably latching the frame to the backboard is comprised of the snap together type whereby each half of one or more mating pairs of snaps are affixed to the respective surfaces of the frame and backboard at mutually opposed locations near one or more edges such that the mating snaps meet in the frame's closed position and can be fastened to close the frame to the backboard securing the edges of the paper therebetween.

11. The clipboard/padholder in claims 2 or 3, 12, 13, 4, 6, 14, 7 where the means for releasably securing the tablet or paper is a clip to which one side of the paper or tablet releasably engages, said clip being permanently affixed to the backboard in a position near one edge of the backboard such that when the frame is in a closed position, substantially all of the topmost paper except for the edges secured between the frame and the backboard, are exposed through the frame opening; and the means for releasably latching the frame to the backboard is comprised of a tab of relatively thin flexible material affixed to and protruding outwardly from one non-hinged side of the frame in the same plane as the frame, one half of a mating pair of velcro pads affixed to the planar surface of the tab facing the plane having in it the paper or tablet, and the other pad of the said velcro pair affixed to the backboard planar surface opposite that backboard surface having the paper or tablet thereon, said pad positioned near the edge of the backboard surface and opposite the tab at a distance from said edge sufficient to enable the frame to firmly secure the edges of the paper when the pad on the flexible tab is selectively mated with the said second pad, thus providing a flexible tab that can be folded around the edge of the backboard to selectively join the mated velcro pads to not only close the frame to the backboard but also firmly secure the edges of the paper or tablet therebetween.

12. The clipboard/padholder in claim 3 wherein the cover has an open position such that the outer surface of the cover is in a facing substantially coplanar relationship with the surface of the backboard, thus providing a nearly 360 degree rotational movement of the cover about the hinged connection.

13. The clipboard/padholder in claim 12 having releasable securing means attached thereto near one or more edges of the cover and backboard to secure the cover to the backboard in either the open or closed position.

14. The clipboard/padholder as in claim 3 wherein the backboard, frame and cover are hingedly connected together at the said hinged edge of each in a slightly spaced apart parallel relationship by a sheath of relatively thin flexible material therebetween and enveloping all planar surfaces of the backboard, frame and cover, the sheath having any exposed edges affixed together at the peripheries of the frame, frame opening, and backboard to the matching opposed exposed edges of the sheath enveloping the opposite planar surface at the respective edge.

15. The clipboard/padholder in claim 14 wherein the sheath is comprised of vinyl-like material and means for attaching edges of the sheath to each other is heat sealing; hinging means between the frame and backboard and cover is enhanced by heat sealing the vinyl material between the backboard, frame and cover at the hinged connection; means for securing a tablet to the backboard are comprised of a slit cut in the sheath of material enveloping the tablet receiving planar surface of the backboard, said slit positioned to allow the tablet cardboard backing to insert slidably therethrough between the sheathing and backboard surface to a secure position such that the frame hinges to a closed position securing only the edges of the paper on the tablet; the releasable latching means is one pad of a mating velcro pad pair, said pad selected to mate with the velcro pad on the tab affixed to the frame, said cover velcro pad positioned on the outside surface of the cover so that when the cover is in the open position the flexible tab on the frame when folded around the edges of the backboard and cover mates the two velcro pads of the cover and flexible tab, respectively, the tab thus simultaneously securing the frame on the paper and backboard and securing the cover in the open position while utilizing the paper; the cover hinges to an open position such that the outer surface of the cover is in a facing substantially coplanar relationship with the surface of the backboard, thus providing a nearly 360° degree rotational movement of the cover about the hinged connection.

16. A clipboard/padholder for firmly yet releasably holding paper, including a plurality thereof in stacked form or in the form of a tablet with cardboard backing, while utilizing the topmost paper thereof by reading or writing on it in windy conditions or where it is desired to secure or maintain neatness of the edges of the paper, comprised of:

a. A flat rigid member comprising a backboard having at least one straight edge;

b. a second flat rigid member of shape substantially similar to the backboard and having an opening in the center, comprising a frame, hingedly connected to the backboard along one of the matching parallel opposed straight edges of the frame and backboard, said frame having an open and a closed position, whereby, in the closed position the paper or tablet is in a substantially coplanar relationship with the frame and backboard and is secured between them at and near the edges of the paper or tablet while exposing through the frame opening substantially all of the topmost paper for utilization; in the open position, the frame hinges away from the paper and backboard to a non-coplanar relationship therewith wherein all physical contact between the frame and paper ceases, for quick removal or replacement of the paper or tablet; the size of the frame opening is such that its dimensions are smaller than the dimensions of the frame perimeter, while allowing for substantially all of the topmost paper to be exposed through the frame opening except for the secured edges of the paper, for utilization of said topmost paper when the frame is in the closed position;

c. A third flat rigid member having a size at least as large as that of the frame opening, said member comprising a cover, and having an inside and outside surface defined by its opposite planar surfaces respectively, said cover hingedly connected between the hinged edge of the backboard and frame having the hinge between the backboard and frame, to the corresponding parallel opposed edge of the cover, and hinging to a closed position wherein the inner surface of the cover is in a facing and substantially coplanar relationship with he frame and entirely covers the frame opening.

* * * * *